US008850728B2

(12) United States Patent
Hein

(10) Patent No.: US 8,850,728 B2
(45) Date of Patent: Oct. 7, 2014

(54) DOUBLE-SIDED DISPLAY STRUCTURE

(76) Inventor: Oliver Karl Hein, Munich (DE)

( * ) Notice: Subject to any disclaimer, the term of this patent is extended or adjusted under 35 U.S.C. 154(b) by 277 days.

(21) Appl. No.: 13/380,629

(22) PCT Filed: Jun. 29, 2010

(86) PCT No.: PCT/EP2010/003932
§ 371 (c)(1),
(2), (4) Date: Dec. 23, 2011

(87) PCT Pub. No.: WO2011/000545
PCT Pub. Date: Jan. 6, 2011

(65) Prior Publication Data

US 2012/0096749 A1 Apr. 26, 2012

(30) Foreign Application Priority Data

Jun. 29, 2009 (GB) ..... 0911190.7

(51) Int. Cl.

| | |
|---|---|
| ***G09F 13/16*** | (2006.01) |
| ***G09F 19/16*** | (2006.01) |
| ***G09F 19/14*** | (2006.01) |
| ***G09F 13/24*** | (2006.01) |

(52) U.S. Cl.
CPC ..... *G09F 19/14* (2013.01); *G09F 19/16* (2013.01); *G09F 13/24* (2013.01)
USPC ..... 40/582; 359/832

(58) Field of Classification Search
None
See application file for complete search history.

(56) References Cited

U.S. PATENT DOCUMENTS

| | | | | |
|---|---|---|---|---|
| 6,961,167 | B2 * | 11/2005 | Prins et al. | 359/253 |
| 2003/0063456 | A1 * | 4/2003 | Katahira | 362/27 |
| 2008/0291152 | A1 | 11/2008 | Nakao et al. | |

* cited by examiner

*Primary Examiner* — Joanne Silbermann
(74) *Attorney, Agent, or Firm* — Jeffrey Van Myers; Artie A. Pennington

(57) ABSTRACT

A double-sided display structure comprising a light transmitting element comprising a light transmitting material. The light transmitting element has a pair of opposed light receiving faces (22) and a pair of opposed light emitting faces (23) substantially orthogonally disposed to the light receiving faces (22). A light reflecting layer (25) is disposed at an oblique angle to the light receiving faces (22) and the light emitting faces (23), and a pair of light-emitting displays (24) for displaying the same or different still and/or moving images are mounted such that an image from a respective light-emitting display (24) is emitted into a respective light receiving face (22) and is transmitted through the light transmitting element to be reflected by the reflecting layer (25) to a respective light emitting face (23), whereby the images received at the pair of opposed light receiving faces (22) are visible to observers through the pair of opposed light emitting faces (23) of the display structure.

18 Claims, 10 Drawing Sheets

DOUBLE-SIDED DISPLAY STRUCTURE

FIELD OF THE INVENTION

This invention relates to a display, particularly, to a double-sided display structure that can be used to show the same or different still and/or moving images on two sides thereof, for example to such a display structure that can be used as an advertising sign.

BACKGROUND OF THE INVENTION

Advertising signs are known in many different shapes, sizes and designs. A common design hitherto has been a sign having a multiplicity of square or triangular shaped prisms, which are arranged to rotate about their axes mounted generally side-by-side with their axes vertically. Each side of the prisms has a vertical strip of a poster or other image mounted on them, and the rotation is synchronized so that all the strips for one image are shown at once to make up a complete image. Thus, for triangular prisms, there can be three different images, which change periodically, as the prisms rotate. For square prisms there can be four different images, with both sides of the sign being visible and displaying different images.

Another type of advertising sign is one that is formed directly of a matrix of light emitting devices, whether of one colour or of several or many different colours. If the matrix is of light sources of a single colour, then they can be controlled to be turned on and off in particular patterns to provide a monochrome advertisement. If there are a large number, particularly if of different colours, then large, self-luminescent advertisements can be produced by programming the controller that controls the switching of the light sources on and off. As light emitting diodes have become available, especially in several colours, this has become a preferred form of the light source for such matrices. Such electronic signs can display either still or moving images. Such signs are not, however, generally double-sided unless two independent such signs are mounted back-to-back.

BRIEF SUMMARY OF THE INVENTION

The present invention therefore seeks to provide a display structure that provides a double-sided display of the same or different still and/or moving images.

Accordingly, in a first aspect, the invention provides a double-sided display structure comprising a light transmitting element comprising a light transmitting material, the light transmitting element having a pair of opposed light receiving faces and a pair of opposed light emitting faces substantially orthogonally disposed to the light receiving faces, a light reflecting layer disposed at an oblique angle to the light receiving faces and the light emitting faces, and a pair of light-emitting displays for displaying the same or different still and/or moving images and being mounted such that an image from a respective light-emitting display is emitted into a respective light receiving face and is transmitted through the light transmitting element to be reflected by the reflecting layer to a respective light emitting face, whereby the images received at the pair of opposed light receiving faces are visible to observers through the pair of opposed light emitting faces of the display structure.

In a preferred embodiment, the light transmitting material has a first refractive index and the light reflecting layer has a second refractive index different to the first refractive index, and the difference in the first and second refractive indices and the oblique angle are sufficient to cause the images to be substantially reflected by the light reflecting layer.

Preferably, the light transmitting material is a first fluid medium and the light reflecting layer includes a second fluid medium, different to the first fluid medium.

In one embodiment, the first fluid medium comprises a liquid, such as water or oil, for example silicone oil, within a tank formed of a solid, light transmitting material, such as glass or plastics material.

The second fluid medium preferably comprises gas, such as air, enclosed within a substantially planar element formed of a pair of walls sealed together at their periphery and formed of solid, light transmitting material, such as glass or plastics material.

In one embodiment, the tank is substantially cylindrical with a pair of end faces forming the pair of opposed light emitting faces, and opposite portions of the curved periphery form the pair of opposed light receiving faces, the planar element extending within the tank at an oblique angle to both the end faces of the tank and the opposed curved portions of the periphery.

Preferably, the planar element is provided with a pair of opposed extensions extending from opposite ends of the planar element at an obtuse angle thereto so as to contact the opposed end faces of the tank and to thereby retain the planar element in position within the tank.

In another embodiment, the tank is substantially cubical or cuboidal with a pair of end faces forming the pair of opposed light emitting faces, and a pair of side faces forming the pair of opposed light receiving faces, the planar element extending within the tank at an oblique angle to both the end faces and the side faces of the tank.

Preferably, the light transmitting element is formed of a pair of tanks of substantially prism-like shape, each having an oblique face substantially adjacent each other with a layer of air therebetween providing the light reflecting layer.

Alternatively, the light transmitting element may be formed of a solid light transmitting material and is formed in two parts of substantially prism-like shape, each having an oblique face substantially adjacent each other with a layer of air therebetween providing the light reflecting layer.

The two parts are preferably formed as right-angled triangular prisms.

The double-sided display structure preferably further comprises a mount for mounting the pair of light-emitting displays adjacent a respective light receiving face, the mount being generally opaque so as to hide the light-emitting displays and the light receiving faces of the light transmitting element.

The mount may comprise, in one embodiment, a pair of spaced mounting members, each member having one of the light-emitting displays and one of the light receiving faces therein, whereby the light transmitting element extends between the spaced mounting elements, such that the light emitting faces are viewable by observers between the spaced mounting members.

Alternatively, the mount may comprise an annular mounting member wherein the light-emitting displays and the light receiving faces are hidden therein, but the light emitting faces of the light transmitting element are visible through the center of the annular mounting member, such that the light emitting faces are viewable by observers.

Preferably, the images displayed by the pair of light emitting displays are different and one such image is visible to an observer looking at one of the light emitting faces and the other such image is visible to an observer looking at the other of the light emitting faces.

The double-sided display structure may comprise a plurality of said light transmitting elements mounted vertically next to each other, with a plurality of pairs of light emitting displays arranged adjacent the light receiving faces of the plurality of light transmitting elements.

The double-sided display structure may further comprise a light assembly arranged to shine light into the light transmitting element.

According to a second aspect, the invention provides an advertising sign comprising a double-sided display structure as described above.

BRIEF DESCRIPTION OF THE DRAWINGS

Embodiments of the invention will now be more fully described, by way of example, with reference to the drawings, of which.

DETAILED DESCRIPTION OF THE DRAWINGS

Figure 1:
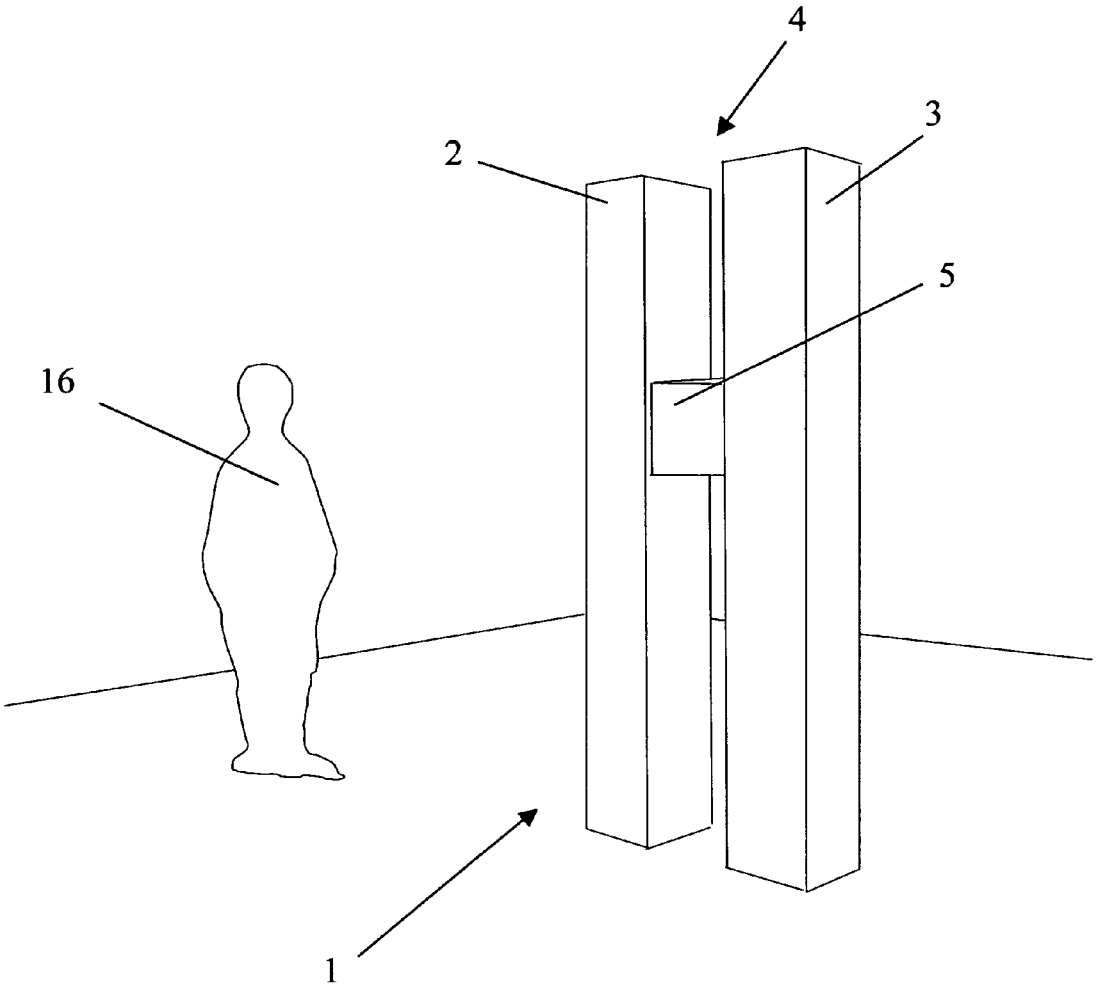
FIG. 1 shows a general perspective view of an advertising sign incorporating a double-sided display structure according to one embodiment of the present invention.
Figure 2:
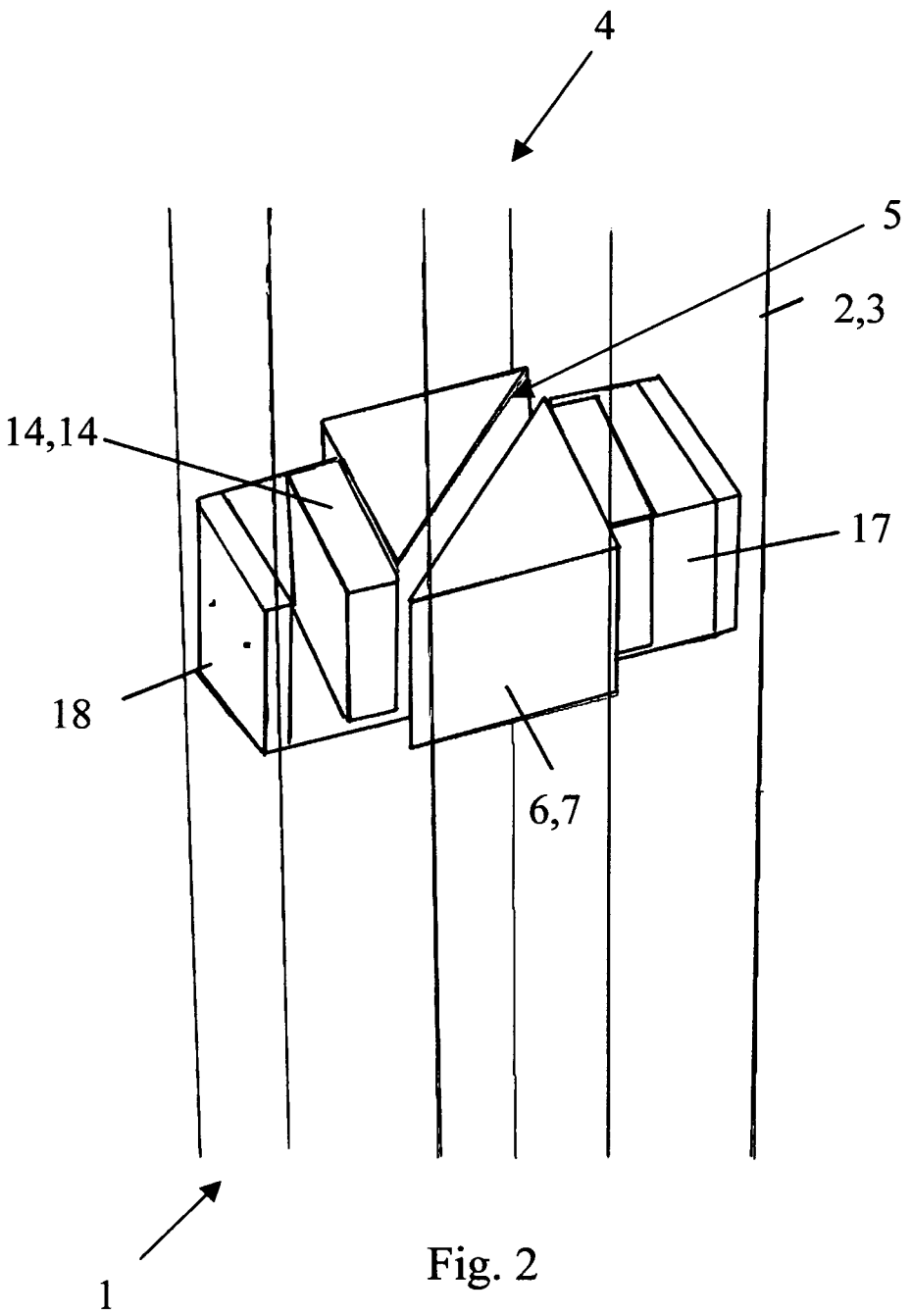
FIG. 2 shows a schematic part-exploded cross-sectional perspective view of the advertising sign of FIG. 1.

Thus, as best shown in FIGS. 1 and 2, an advertising sign 1 according to a first embodiment of the invention incorporates a double sided display structure including pair of mounting members 2, 3, which together form a mount 4 of the sign 1. The mounting members 2, 3 are generally opaque and may be formed, for example, from wood (for example Oak) or plastics material. They are arranged to be mounted generally vertically in the ground, either directly or in a base.

Figure 3:
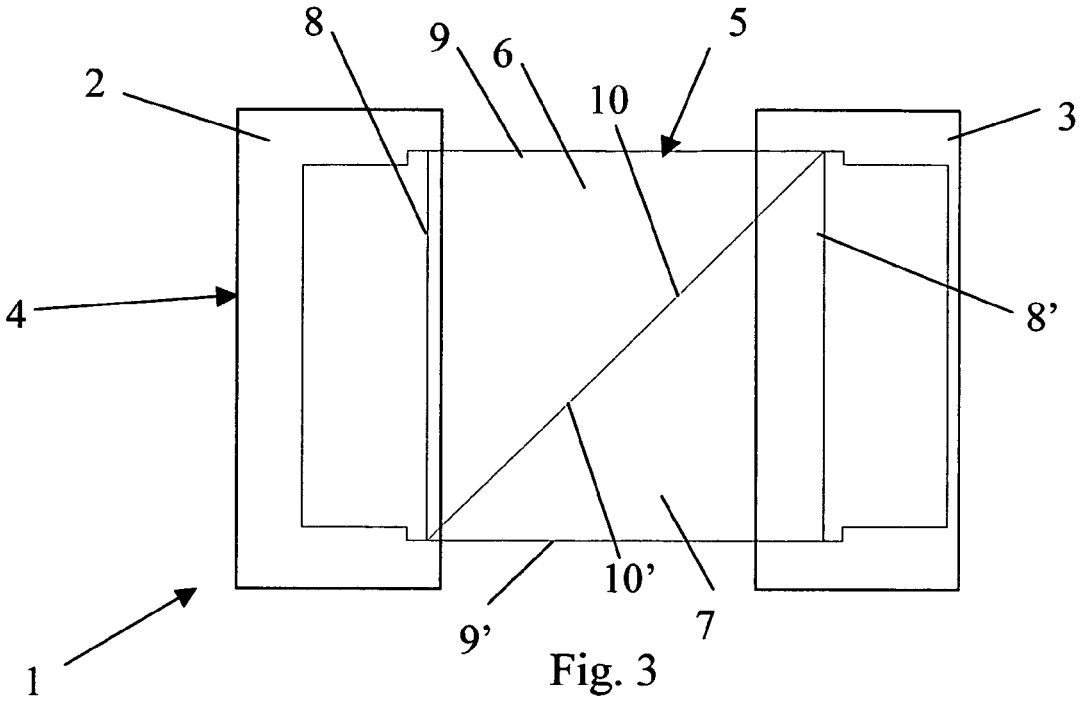
FIG. 3 shows a schematic part cross-sectional plan view of the advertising sign of FIG. 1.
Figure 4:
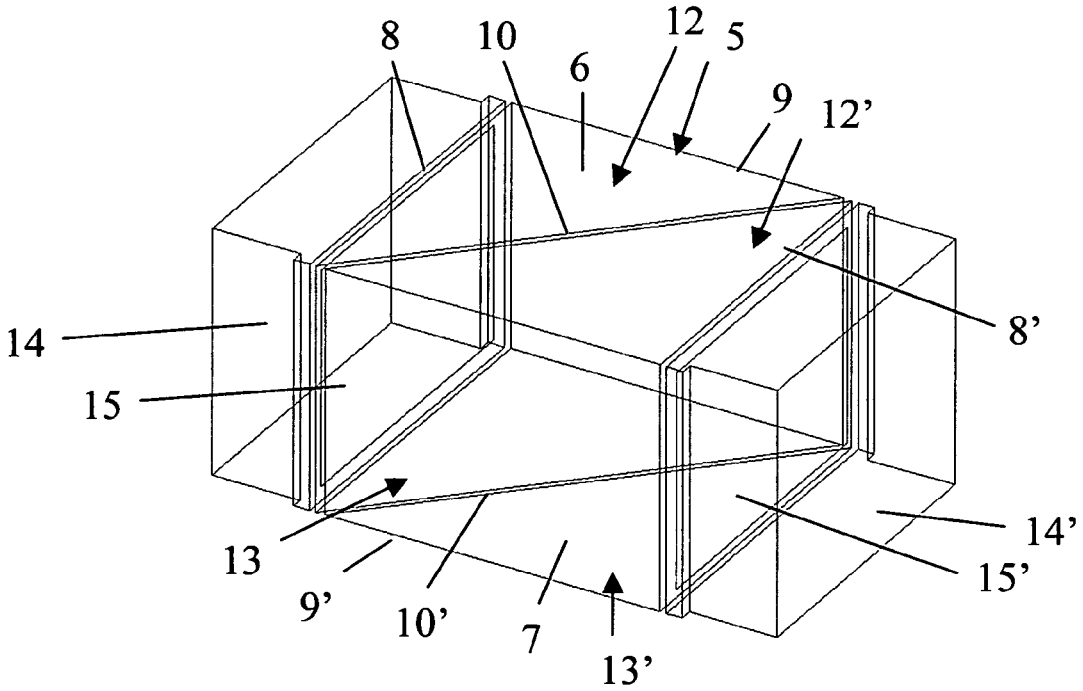
FIG. 4 shows an exploded perspective view of the advertising sign of FIG. 2 without the mount.

A generally cuboidal transparent block 5 is mounted between the pair of mounting elements 2, 3. The block 5 (as also shown in FIGS. 3 and 4) is made of a pair of triangular prisms 6, 7 made of glass or other transparent material such as Perspex or other plastic material, such as acrylic. Each prism 6, 7 is a right-angled triangular prism having a first, light-receiving face 8, 8' and a second, light-emitting face 9, 9' defining a right angle between them and a hypotenuse face 10, 10' extending therebetween. Each prism 6, 7 also has a top 12, 12' and a bottom 13, 13' triangular face. The prisms 6, 7 are mounted in the mounting elements 2, 3 such that their hypotenuse faces 10, 10' are in contact with each other, with the two hypotenuse faces 10, 10' extending generally vertically from one corner to a diagonally opposite corner of the block 5. Preferably, as shown, the first face 8, 8' of each prism 6, 7 is enclosed within a respective mounting member 2, 3, such that the second faces 9, 9' of the prisms 6, 7 extend between the two mounting elements 2, 3 to be visible to an observer 16.

As best shown in FIGS. 2 to 4, the advertising sign 1 also comprises a pair of light-emitting displays 14, 14', each having a screen 15, 15' for displaying an image, mounted, respectively, within the mounting members 2, 3 such that respective screens 14, 14' thereof are adjacent to or in contact with respective first faces 8, 8' of the prisms 6, 7. Thus, the displays 14, 14' are also enclosed within the respective mounting members 2, 3, whereby the images are emitted from the screens 15, 15' into the respective prisms 6, 7 through their first faces 8, 8'. The images are then internally reflected within each prism 6, 7 and pass through the second faces 9, 9' thereof so as to be visible to observers of the second faces of the prisms.

As shown in FIG. 2, the displays, having video screens, may be mounted within hollowed out spaces 17 within the mounting members 2, 3, which are closed off by lids 18. The mounting members may be, as illustrated in FIG. 1, railway sleepers or similar wooden members, and the lids may then also be wooden. Furthermore, as shown in FIG. 2, the prisms may extend between the mounting members at an angle, rather than perpendicularly between them.

The light-emitting displays 14, 14' are preferably similar to portable electronic displays of the well known type that display either still images, or moving images, which may be stored either in internal memory of the device, for example in MP4 format, on an external memory and coupled via a wire or wirelessly to the device, or be stored on a storage medium, for example a DVD or CD ROM and played by the device. It will be appreciated that the method whereby the image is displayed on the screen of each device is immaterial and any suitable method will suffice. In a preferred embodiment, the devices are portable MP4 players that can display either still or moving images, and can be programmed to change the images displayed either in a predetermined or in random sequence. The screens, can be either LCD or LED or any other suitable light-emitting display which generates an image that can be seen through the prisms.

Thus, it will be apparent that, in the above-described embodiment, the displays and the first faces of the prisms are enclosed within the mounting members and are not visible to an observer. An observer can only see a second face of a prism and there sees only an image from one of the diplays which has been reflected from the hypotenuse face of that prism. However, when an observer moves to look at the other second face of the other prism, only the other image from the other display is visible, and the two images thus appear to be visible from the two sides of the block 5 without any visible means of their generation.

Since each of the two images is independently generated, and is visible from an opposite face of the block 5, the advertising sign can be used to provide two different images and, if the sign is positioned, for example, at a doorway which serves as an entrance and an exit to a building, the sign could display a first image appropriate for someone entering the building on one side and an image appropriate to someone leaving the building on the other side.

Nevertheless, although the scale of the above described embodiment is shown as being fairly large, with the mounting members being firmly affixed in the ground so that the images are visible at about eye level of an observer, it will be appreciated that other embodiments could be made either smaller or larger. For example, it is envisaged that the device could be made of small acrylic prisms with small light emitting displays arranged on opposing faces, so that images, still or moving, could be displayed through the other opposed faces. Such a device could be made portable, event to the extent of being small enough to be attached to a key ring, for example to display souvenir images of a particular location, with or without advertising images displayed thereon. Such a souvenir image display could thus be made relatively cheaply, if the light emitting displays were to be made cheaply, for example displaying a small selection of images, such a set of slides Alternatively, the structure could be made even larger that originally described, by mounting several blocks made up of pairs of prisms, with associated displays, vertically next to each other in the mount, with the mounting members being elongate and extending vertically, so that a number of images can be seen from each side of the sign.

Figure 5:
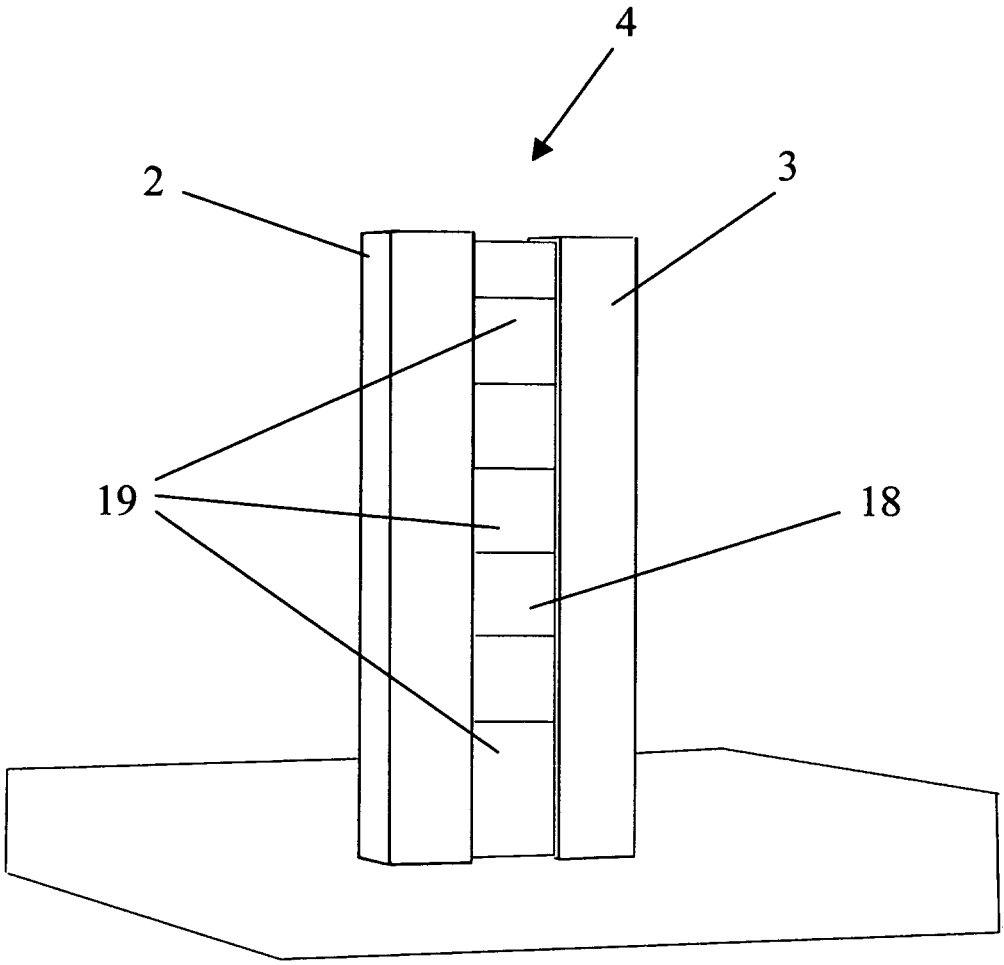
FIG. 5 shows a general perspective view of an advertising sign incorporating a double-sided display structure according to a second embodiment of the present invention.
Figure 6:
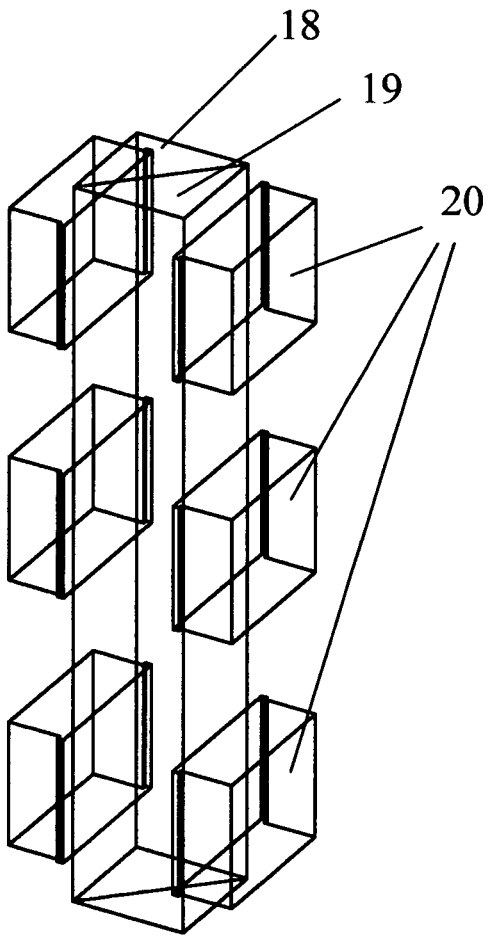
FIG. 6 shows a schematic exploded perspective view of the advertising sign of FIG. 5 without the mount

In another embodiment, as shown schematically in FIGS. 5 and 6, the prisms could be made of glass tanks 18, 19 filled with transparent liquid, such as water, or suitable oil, such as silicone oil, which may be coloured. In such a case, the top triangular face of the prisms may be formed either by the surface of the liquid or by a lid mounted on the glass tank. Furthermore, the glass tanks 18, 19 may extend vertically so that a plurality of displays 20 are mounted vertically next to each other such that their respective screens are adjacent to or in contact with a respective first face of a prism. Thus, a number of images would be visible in a column through the faces of the tanks 18, 19 as shown.

If desired, depending on the images to be displayed and the effects that may be required, a lighting assembly may also be provided to shine light onto the top and/or bottom faces of the prisms.

Figure 7:
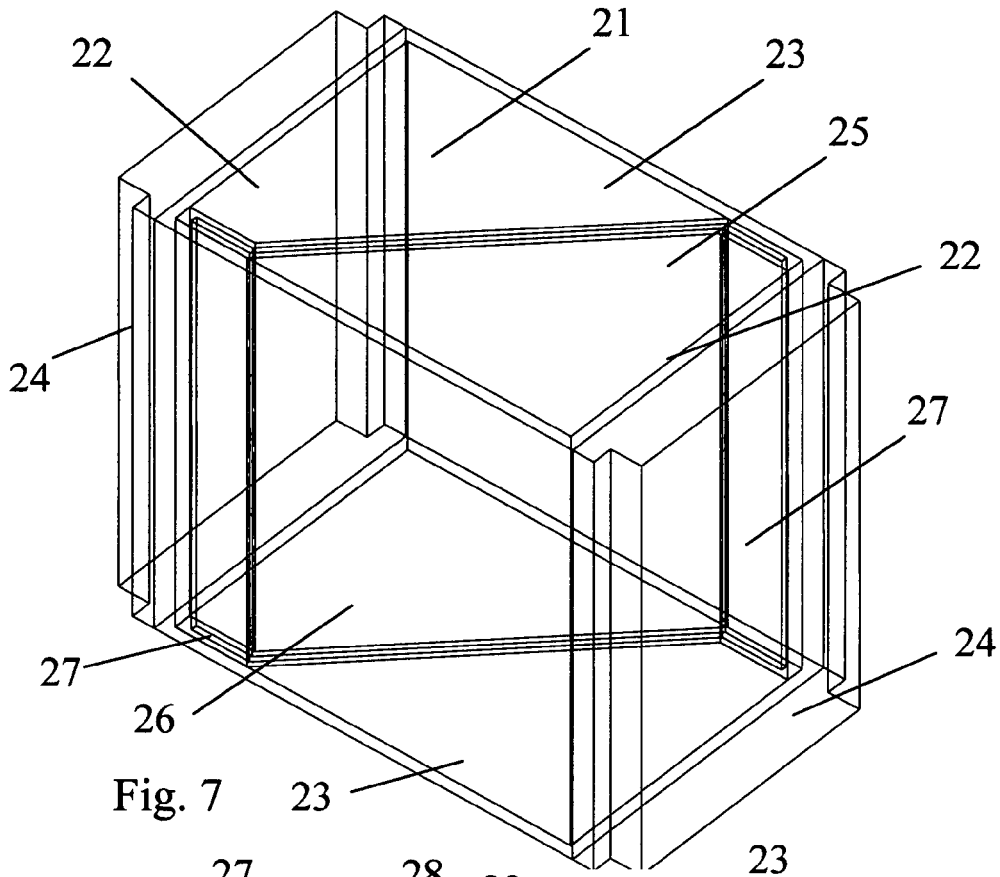
FIG. 7 shows a schematic part-exploded cross-sectional perspective view of a display structure according to a third embodiment of the invention.
Figure 8:
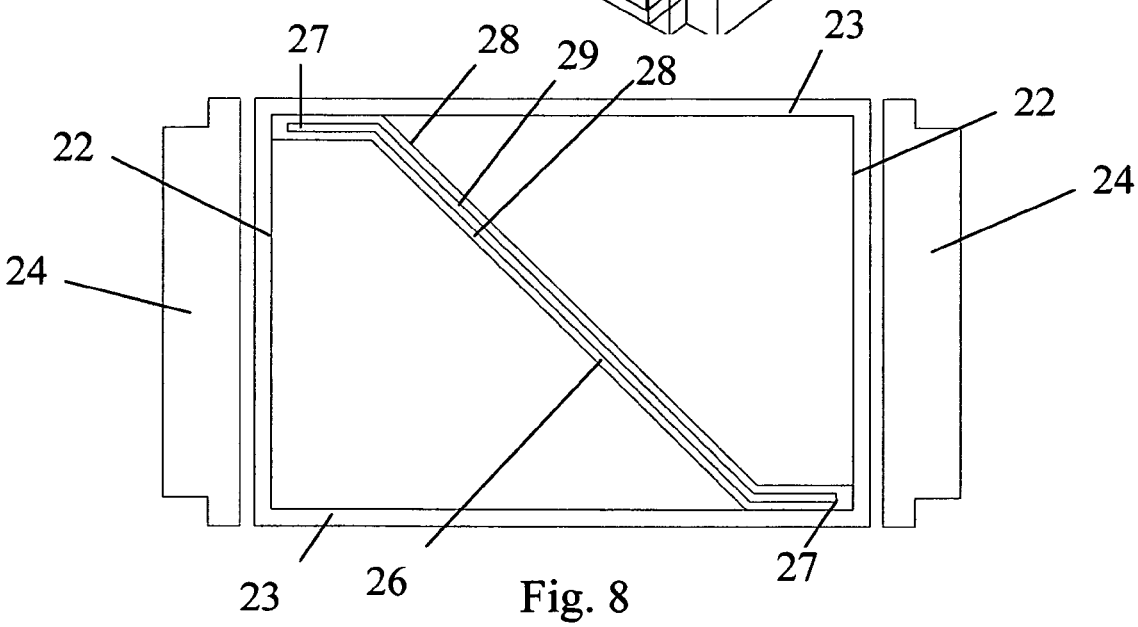
FIG. 8 shows a plan view of the display structure of FIG. 7.

A further embodiment of the invention will now be described with reference to FIGS. 7 and 8 of the drawings. In this case, a cuboidal tank 21 is provided with ends, light-receiving faces 22, and side, light-emitting faces 23. The tank 21 is filled with a liquid, such as water, or oil (for example a silicone oil). Light emitting displays 24 are arranged adjacent the end faces 22 so as to emit their respective images into the tank 21 through the end, light receiving faces. Within the tank 21 there is positioned a light interface 25 having a different refractive index to that of the liquid. In this case, the light interface 25 comprises a planar element 26 having extensions 27 at each end. The extensions 27 are at an obtuse angle to the planar element 26 and are configured to contact the rest against the side faces 23 so as to position the planar element 26 diagonally across the tank at an oblique angle to the end and side faces. The planar element 26, in this case, is formed of a pair of glass or plastic sheets 28 having a layer 29 of gas, such as air, enclosed within them. The gas has a refractive index different to that of the liquid within the tank, and the difference in the refractive indices, together with the angle at which the image is incident on the planar element 26 causes the image light to be reflected by the planar element towards that side faces 23, where they can be viewed by observers.

Figure 9:
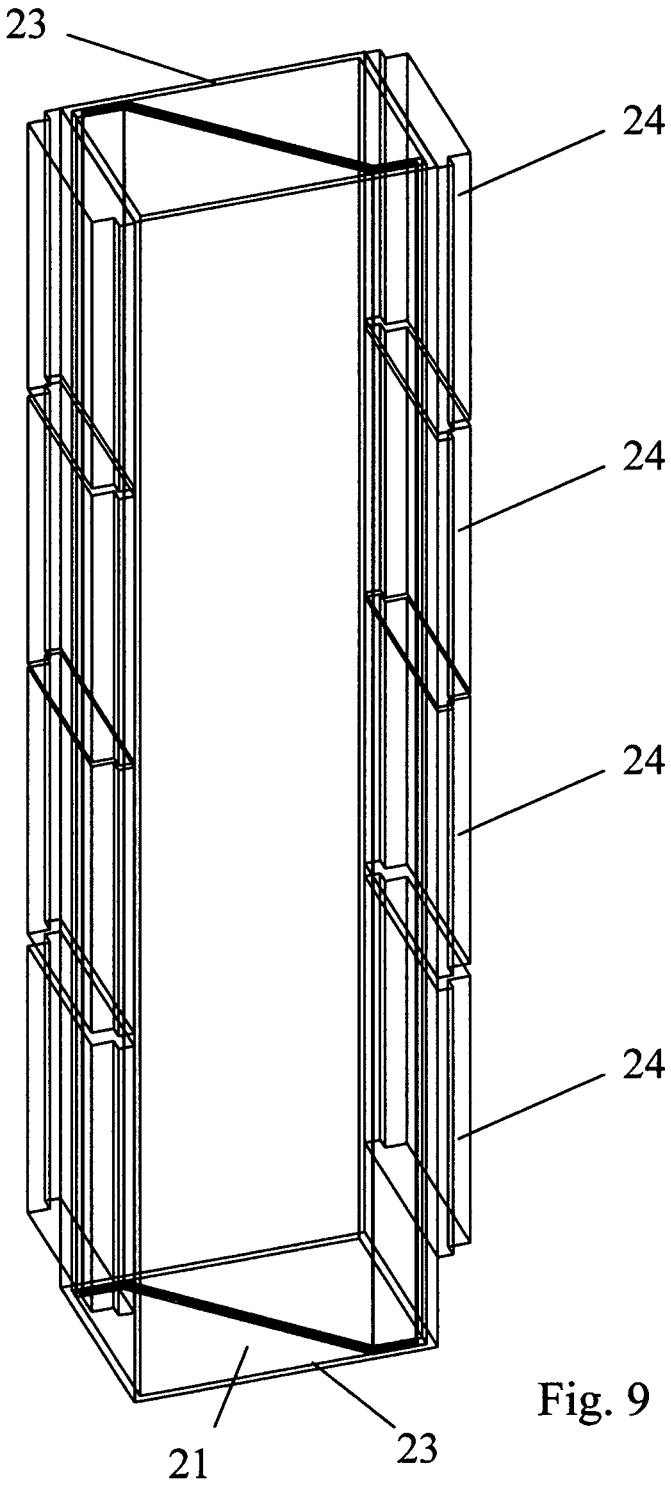
FIG. 9 shows a schematic part-exploded cross-sectional perspective view of a display structure according to a fourth embodiment of the invention.

As can be seen in FIG. 9, the tank 21 can be extended vertically so as to allow several pairs of light emitting displays 24 to be mounted vertically adjacent to each other on opposed end faces thereof, similarly to the embodiment described above with reference to FIG. 6. Thus, a number of images would be visible in a column through the side faces 23 of the tank 21.

Figure 10:
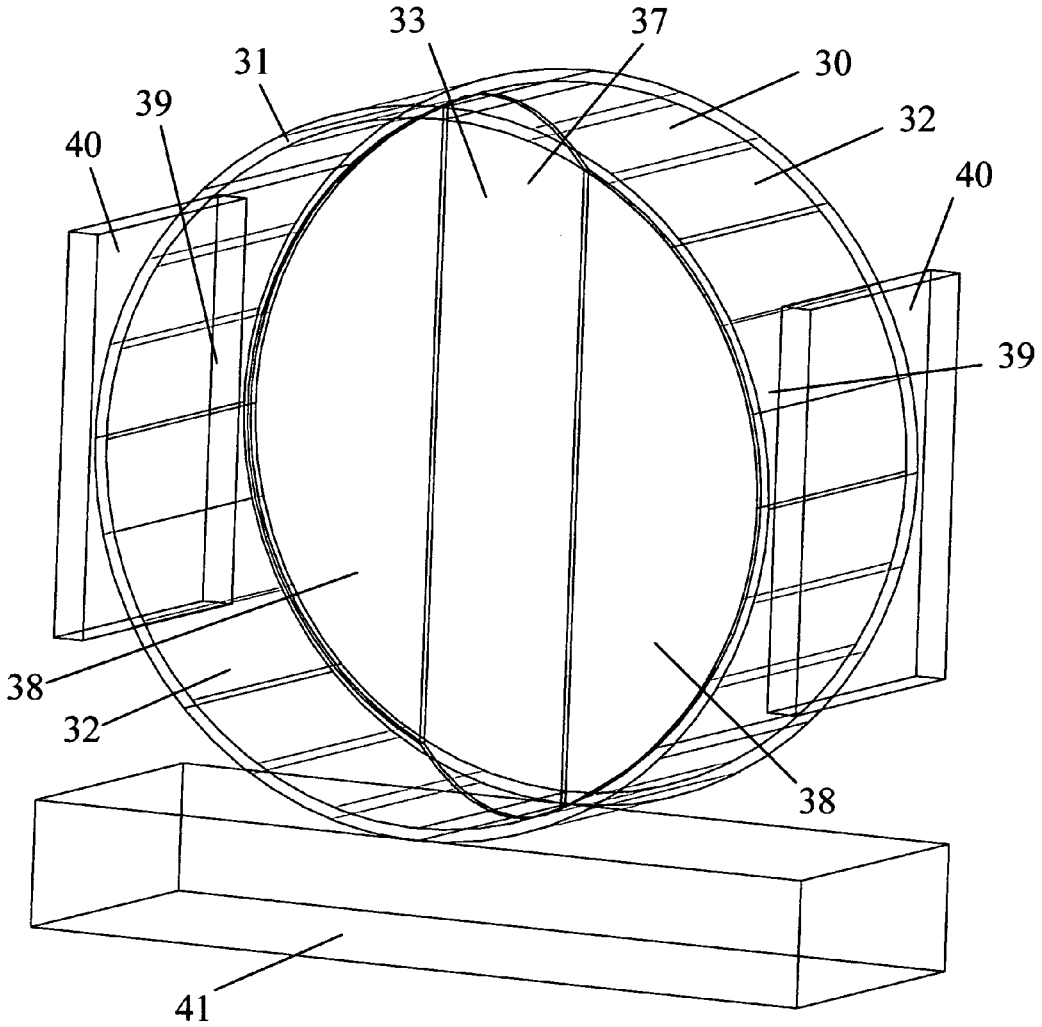
FIG. 10 shows a schematic part-exploded cross-sectional perspective view of a display structure according to a further embodiment of the invention.
Figure 11:
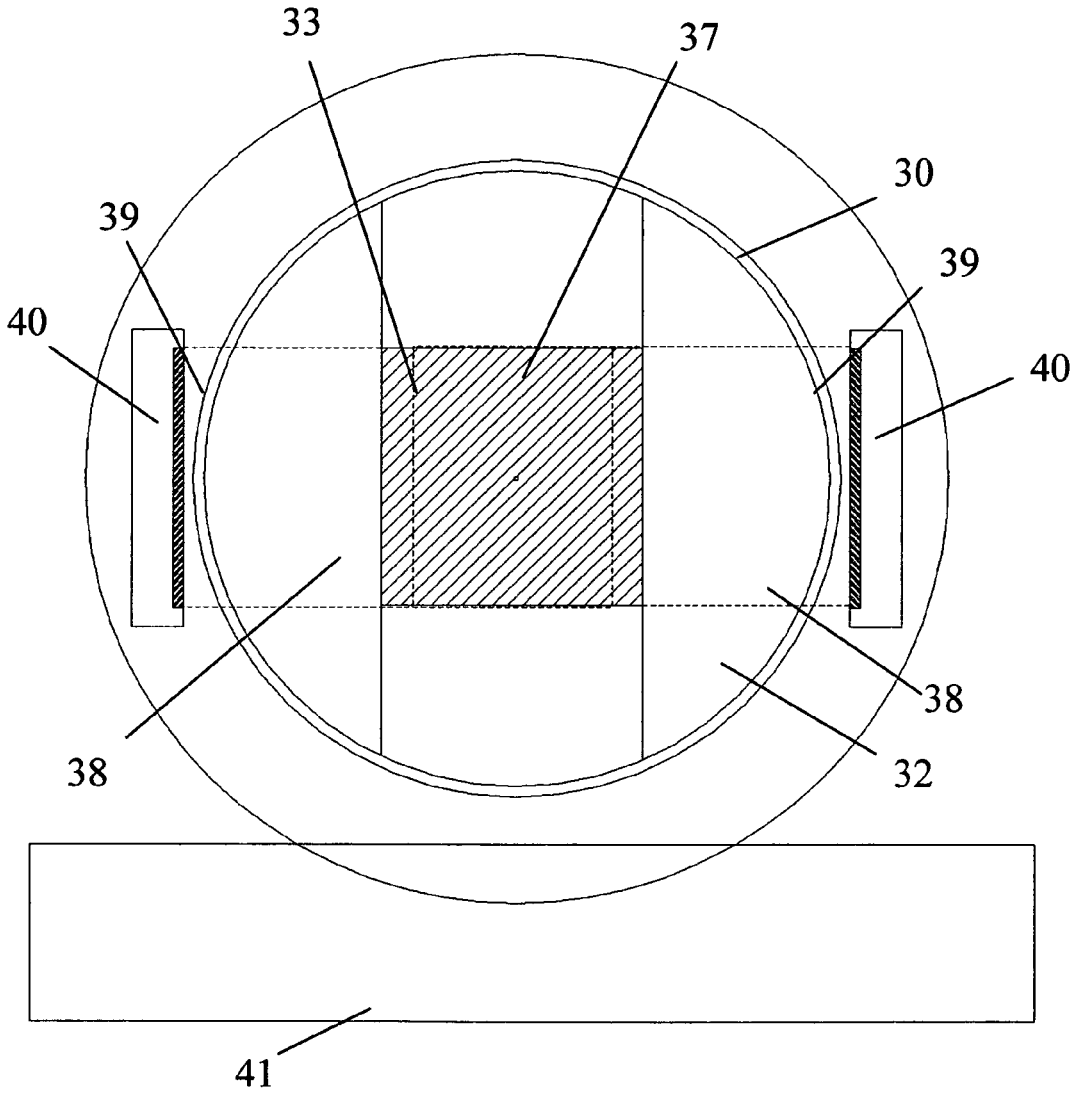
FIG. 11 shows a side view of the display structure of FIG. 10.
Figure 12:
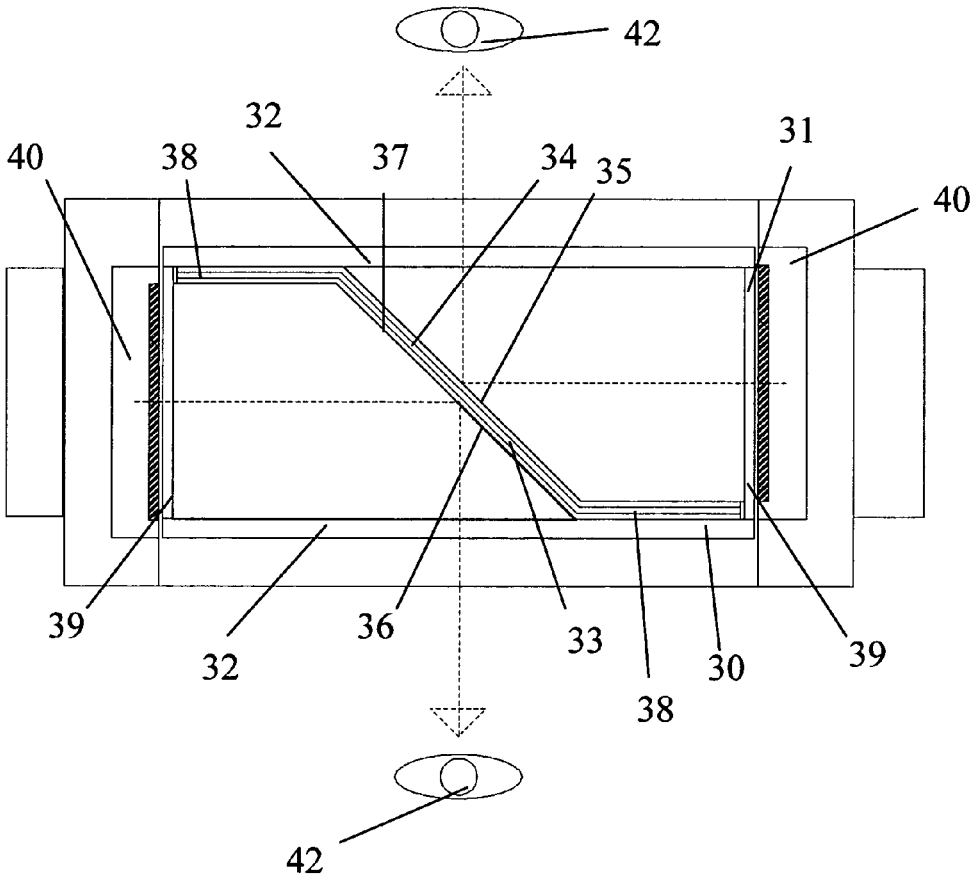
FIG. 12 shows a cross-sectional plan view of the display structure of FIG. 10.

A still further embodiment of a display structure can be seen in FIGS. 10 to 12. In this case, there is provided a cylindrical tank 30 having a circular periphery 31 and a pair of end, light-emitting faces 32. As before the tank 30 is filled with a liquid, such as a silicone oil and a light reflecting layer 33 is provided within the tank 30. The light reflecting layer 33 is formed of a layer 34 of air sandwiched between and enclosed by a pair of sheets 35, 36 of acrylic plastic. The light reflecting layer 33 includes a planar element 37 having extensions 38 arranged to extend at an obtuse angle thereto so as to be positioned adjacent the end faces 32 to maintain the planar element 37 at an oblique angle to the end faces 32 and to diametrically opposed, light-receiving portions 39 of the periphery 31, adjacent to which are mounted a pair of light emitting displays 40. The tank 30 is mounted on a support 41. As best shown in FIG. 11, the tank is surrounded by a mount 43 for mounting the light emitting displays 40 against the diametrically opposed portions 39 of the periphery 31 and to hide the light emitting displays 40 and the periphery 31 of the tank 30 from view by an observer 42, so that only the end faces 32 are visible to observers 42, whereby the observers 42 can view the images reflected by the reflecting layer 33 to the end faces 32 in the manner described above, as shown in FIG. 12.

It will be appreciated that although only a few particular embodiments of the invention have been described in detail, various modifications and improvements can be made by a person skilled in the art without departing from the scope of the present invention. For example, it will be apparent that it does not matter what media are used for the light transmitting element, provided that the light from the light emitting displays can pass through the medium to the reflecting layer, which, again, can be of any material, including a double sided reflecting material, such as a mirror, if desired, although a layer of a medium having a different refractive index to that of the material forming the light transmitting element is preferable. The shape of the light transmitting element may be any desired shape, for example cubic, cuboidal or cylindrical, as described, or any other desired shape. Furthermore, as explained, the scale of the display structure can be anything from portable in one hand, or smaller, to large fixed structures, and can be used to display images, such as souvenir images, which can be still or moving, or advertising images, whether commercial advertising, or information signs or images. Finally, as explained, the light emitting element can be solid or liquid and can be formed of two separate parts with a layer of air therebetween, or as a single element with a layer of air or other appropriate material arranged within the element to provide the reflecting layer.

The invention claimed is:

1. A double-sided display structure comprising:

a light transmitting element comprising a light transmitting material, the light transmitting element having:

a pair of opposed light receiving faces, a pair of opposed light emitting faces substantially orthogonally disposed to the light receiving faces, and a light reflecting layer disposed at an oblique angle to the light receiving faces and the light emitting faces, and a pair of light-emitting displays, each adapted to display a selected one of a still and a moving image, and being mounted such that the image displayed by a respective display is emitted into a respective light receiving face, transmitted through the light transmitting element, and reflected by the reflecting layer to a respective light emitting face, whereby the images displayed at the pair of opposed light receiving faces are visible to observers through the pair of opposed light emitting faces of the display structure.

2. A double-sided display structure according to claim 1, wherein the light transmitting material has a first refractive index and the light reflecting layer has a second refractive index different to the first refractive index, and the difference in the first and second refractive indices and the oblique angle are sufficient to cause the images to be substantially reflected by the light reflecting layer.

3. A double-sided display structure according to claim 1, further comprising a mount for mounting the pair of light-emitting displays adjacent a respective light receiving face, the mount being generally opaque so as to hide the light-emitting displays and the light receiving faces of the light transmitting element.

4. A double-sided display structure according to claim 3, wherein the mount comprises a pair of spaced mounting members, each member having one of the light-emitting displays and one of the light receiving faces therein, whereby the light transmitting element extends between the spaced mounting elements, such that the light emitting faces are viewable by observers between the spaced mounting members.

5. A double-sided display structure according to claim 3, wherein the mount comprises an annular mounting member wherein the light-emitting displays and the light receiving faces are hidden therein, but the light emitting faces of the light transmitting element are visible through the center of the annular mounting member, such that the light emitting faces are viewable by observers.

6. A double-sided display structure according to claim 1, wherein the images displayed by the pair of light emitting displays are different and one such image is visible to an observer looking at one of the light emitting faces and the other such image is visible to an observer looking at the other of the light emitting faces.

7. A double-sided display structure according to claim 1, comprising a plurality of said light transmitting elements mounted vertically next to each other, with a plurality of pairs of light emitting displays arranged adjacent the light receiving faces of the plurality of light transmitting elements.

8. A double-sided display structure according to claim 1, further comprising a light assembly arranged to shine light into the light transmitting element.

9. An advertising sign comprising a double-sided display structure according to claim 1.

10. A double-sided display structure comprising a light transmitting element comprising a light transmitting material, the light transmitting element having a pair of opposed light receiving faces and a pair of opposed light emitting faces substantially orthogonally disposed to the light receiving faces, a light reflecting layer disposed at an oblique angle to the light receiving faces and the light emitting faces, and a pair of light-emitting displays for displaying images and being mounted such that an image from a respective light-emitting display is emitted into a respective light receiving face and is transmitted through the light transmitting element to be reflected by the reflecting layer to a respective light emitting face, whereby the images received at the pair of opposed light receiving faces are visible to observers through the pair of opposed light emitting faces of the display structure, wherein:

the light transmitting material has a first refractive index and the light reflecting layer has a second refractive index different to the first refractive index, and the difference in the first and second refractive indices and the oblique angle are sufficient to cause the images to be substantially reflected by the light reflecting layer; and the light transmitting material is a first fluid medium and the light reflecting layer includes a second fluid medium, different to the first fluid medium.

11. A double-sided display structure according to claim 10, wherein the first fluid medium comprises a liquid within a tank formed of a solid, light transmitting material.

12. A double-sided display structure according to claim 11, wherein the second fluid medium comprises gas enclosed within a substantially planar element formed of a pair of walls sealed together at their periphery and formed of solid, light transmitting material.

13. A double-sided display structure according to claim 12, wherein the tank is substantially cylindrical with a pair of end faces forming the pair of opposed light emitting faces, and opposite portions of the curved periphery form the pair of opposed light receiving faces, the planar element extending within the tank at an oblique angle to both the end faces of the tank and the opposed curved portions of the periphery.

14. A double-sided display structure according to claim 13, wherein the planar element is provided with a pair of opposed extensions extending from opposite ends of the planar element at an obtuse angle thereto so as to contact the opposed end faces of the tank and to thereby retain the planar element in position within the tank.

15. A double-sided display structure according to claim 12, wherein the tank is substantially cubical or cuboidal with a pair of end faces forming the pair of opposed light emitting faces, and a pair of side faces forming the pair of opposed light receiving faces, the planar element extending within the tank at an oblique angle to both the end faces and the side faces of the tank.

16. A double-sided display structure according to claim 11, wherein the light transmitting element is formed of a pair of tanks of substantially prism-like shape, each having an oblique face substantially adjacent each other with a layer of air therebetween providing the light reflecting layer.

17. A double-sided display structure comprising a light transmitting element comprising a light transmitting material, the light transmitting element having a pair of opposed light receiving faces and a pair of opposed light emitting faces substantially orthogonally disposed to the light receiving faces, a light reflecting layer disposed at an oblique angle to the light receiving faces and the light emitting faces, and a pair of light-emitting displays for displaying images and being mounted such that an image from a respective light-emitting display is emitted into a respective light receiving face and is transmitted through the light transmitting element to be reflected by the reflecting layer to a respective light emitting face, whereby the images received at the pair of opposed light receiving faces are visible to observers through the pair of opposed light emitting faces of the display structure, wherein:

the light transmitting material has a first refractive index and the light reflecting layer has a second refractive index different to the first refractive index, and the difference in the first and second refractive indices and the oblique angle are sufficient to cause the images to be substantially reflected by the light reflecting layer; and the light transmitting element is formed of a solid light transmitting material and is formed in two parts of substantially prism-like shape, each having an oblique face substantially adjacent each other with a layer of air therebetween providing the light reflecting layer.

18. A double-sided display structure according to claim 17, wherein the two parts are formed as right-angled triangular prisms.

* * * * *